US008123333B2

(12) United States Patent
Ito

(10) Patent No.: US 8,123,333 B2
(45) Date of Patent: Feb. 28, 2012

(54) IMAGE FORMING APPARATUS AND HEAD UNIT

(75) Inventor: Masaharu Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 882 days.

(21) Appl. No.: 12/215,576

(22) Filed: Jun. 27, 2008

(65) Prior Publication Data

US 2009/0002468 A1 Jan. 1, 2009

(30) Foreign Application Priority Data

Jun. 29, 2007 (JP) ..... 2007-172984

(51) Int. Cl.
*B41J 2/165* (2006.01)

(52) U.S. Cl. ..... 347/34; 347/32; 347/37

(58) Field of Classification Search ..... 347/34, 347/37, 40, 67

See application file for complete search history.

(56) References Cited

U.S. PATENT DOCUMENTS

| | | | | |
|---|---|---|---|---|
| 6,604,813 | B2 * | 8/2003 | Green | 347/47 |
| 7,726,775 | B2 * | 6/2010 | Maeda | 347/37 |
| 2002/0089563 | A1 | 7/2002 | Tanaka | |

FOREIGN PATENT DOCUMENTS

| | | |
|---|---|---|
| JP | 2002-273859 | 9/2002 |
| JP | 2004130550 | 4/2004 |
| JP | 2005007660 | 1/2005 |

* cited by examiner

*Primary Examiner* — Thinh Nguyen

(74) *Attorney, Agent, or Firm* — Frommer Lawrence & Haug LLP

(57) ABSTRACT

An image forming apparatus includes a head unit which has, on a bottom wall of the head unit, a jetting head having a plurality of nozzles for jetting the liquid droplets, and which jets the liquid droplets from the nozzles onto the recording medium while moving in a scanning direction; a gas inlet port which is open through a side wall, the side wall being orthogonal to the scanning direction of the head unit, and via which a gas is taken into the head unit when the head unit moves in the scanning direction; and a pair of gas discharge ports which is open through the bottom wall of the head unit, at positions on both sides in a direction orthogonal to the scanning direction, to interpose the nozzles therebetween, and via which the gas, taken from the gas inlet port, is discharged toward the recording medium.

12 Claims, 11 Drawing Sheets

IMAGE FORMING APPARATUS AND HEAD UNIT

CROSS REFERENCE TO RELATED APPLICATION

The present application claims priority from Japanese Patent Application No. 2007-172984, filed on Jun. 29, 2007, the disclosure of which is incorporated herein by reference in its entirety.

BACKGROUND OF THE INVENTION

1. Field of the Invention

The present invention relates to an image forming apparatus which forms an image by jetting droplets of a liquid such as an ink from a plurality of nozzles toward a recording medium, while moving a head unit having the plurality of nozzles, and relates to the head unit.

2. Description of the Related Art

As it is shown in FIG. 6A and FIG. 6B, an ink-jet printer, which forms an image on a recording paper 82 by jetting ink droplets from a plurality of nozzles toward the recording paper 82 while moving a jetting head 81 in a scanning direction, has been used practically. In this ink-jet printer, when the jetting head 81 is moved, air enters relatively between the jetting head 81 and the recording paper 82 from one end of a movement direction of the recording head 81, and this air flows in one direction of the scanning direction. Since both sides orthogonal to the scanning direction between the jetting head 81 and the recording paper 82 (in other words, both sides in a transporting direction of the recording paper) are open, thereafter, the air escapes to the both sides, in the transporting direction, at which a resistance is low (FIG. 6A is a plan view explaining this state). As a result, an air current A, which spreads over the both side in the transporting direction while flowing in one direction of the scanning direction, is formed between the jetting head 81 and the recording paper 82, on both sides in the scanning direction and nearby.

Moreover, generally, it has been known that ink droplets which are jetted from the nozzle include a main droplet 83*b* which is accompanied by a satellite droplet 83*a* having a weight smaller than the main droplet. Since the main droplet 83*b* is heavier in weight, the main droplet 83*b* is not so affected by the air current A, and flies almost straight from the nozzle. On the other hand, the satellite droplet 83*a* jetted from the nozzles on both sides in the transporting direction flies to be deflected in a direction in which the air current A spreads. Consequently, as shown in FIG. 6B, the satellite droplet 83*a* jetted from the nozzle at an intermediate portion in the transporting direction while flying to be deflected lands on the recording paper 82 at a position which is horizontal in the scanning direction of the main droplet 83*b*. On the other hand, the satellite droplet 83*a*, in the air current A which spreads toward both sides in the transporting direction, lands at a position which is shifted to be inclined with respect to the main droplet 83*b*. As a result, relative positions of landing of the satellite droplet 83*a* and the main droplet 83*b* are different between near the center position of the transporting direction and both sides of the transporting direction. Therefore, a dot which is formed by the satellite droplet 83*a* and the main droplet 83*b* is shifted from a desired position of landing, and a diameter and a shape of the dot are not uniform, thereby causing a defective image quality.

When the main droplet 83*b* is fine, or a jetting speed is slow, there is a possibility that the main droplet 83*b* is affected by the air current A. In this case, there is a possibility that the defective image quality becomes more substantial.

Moreover, when ink droplets are jetted from a nozzle, not only the main droplet 83*b* and the satellite droplet 83*a*, but also more fine ink particles called as a mist are known to be formed. It is considered that the mist is generated by an air current between the jetting head and the recording paper, when the ink is ejected from the nozzle and divided into the main droplets 83*b* and the satellite droplets 83*a*. Moreover, the mist is floated by the air current which is generated by the movement of the jetting head.

For preventing the mist and the satellite droplets of the ink from being floated over a wide range, in a jetting head according to a conventional technology, a discharge port which is capable of discharging air toward the recording paper is formed at a front side in the scanning direction. For example, in a recording head described in US Patent Application Laid-open No. US-2002089563 (corresponds to Japanese Patent Application Laid-open No. 2002-273859), an air curtain is formed at a front side in the scanning direction with respect to nozzles by discharging air from the discharge port. Due to the air curtain, an air current between the jetting head and the recording paper, which is formed when the jetting head is moved, is blocked, and the mist and the satellite droplets of the ink are prevented from being floated over a wide range.

However, in the recording head of the conventional technology, the space between the jetting head and the recording paper is open in the scanning direction and the transporting direction. According to such a structure, an air curtain is formed and air is intercepted at the front side of the jetting head. However, air is blown between the jetting head and the recording paper from both sides of the transporting direction, and a vortex flow is generated at a rear side of the air curtain. The vortex flow disturbs the air current between the jetting head and the recording paper, and the liquid droplets land at an undesired position of the recording paper. In this manner, although the jetting head of the conventional technology is capable of preventing the floating of the mist and the satellite droplets of the ink over a wide range, it is difficult to land a dot accurately at a desired position, and to make uniform a diameter and a shape of the dots.

SUMMARY OF THE INVENTION

An object of the present invention is to provide an image forming apparatus which is capable of forming a high quality image by landing a dot of ink droplets jetted from each nozzle at a desired position, and by making a diameter and a shape of the dots uniform.

According to a first aspect of the present invention, there is provided an image forming apparatus which forms an image by jetting liquid droplets of a liquid onto a recording medium, the apparatus including: a head unit which has, on a bottom wall of the head unit, a jetting head having a plurality of nozzles for jetting the liquid droplets, and which jets the liquid droplets from the nozzles onto the recording medium while moving in a scanning direction; a gas inlet port which is open through a side wall, the side wall being orthogonal to the scanning direction of the head unit, and via which a gas is taken into the head unit when the head unit moves in the scanning direction; and a pair of gas discharge ports which is open through the bottom wall of the head unit, at positions on both sides in a direction orthogonal to the scanning direction, to interpose the nozzles therebetween, and via which the gas, taken from the gas inlet port, is discharged toward the recording medium.

When the head unit is moved in the scanning direction, a gas is taken in via the gas inlet port, and the gas taken in is discharged through the pair of gas discharge ports, toward the recording medium. The pair of gas discharge ports is formed in the bottom wall of the head unit, at positions on both sides in a direction orthogonal to the scanning direction, to interpose the nozzles therebetween. Therefore, by the gas which is discharged from the pair of gas discharge ports, it is possible to form a layer of gas in other words, an air curtain, which flows toward the recording medium on both sides with respect to the nozzles in the direction orthogonal to the scanning direction. Accordingly, when the head unit is moved, it is possible to suppress an air current which spreads over the both sides orthogonal to the scanning direction, between the jetting head and the recording medium. Further, it is possible to land the liquid droplets jetted from the nozzle on the recording medium without being deflected in the direction orthogonal to the scanning direction, and thereby facilitating to make uniform a diameter and a shape of dots.

Moreover, in the present invention, it is possible to reduce an amount of gas which spreads over both sides orthogonal to the scanning direction from a space between the jetting head and the recording medium by intercepting a gas flow on both sides in the direction orthogonal to the scanning direction, between the jetting head and the recording medium. In other words, it is possible to reduce the amount of gas entering between the jetting head and the recording medium. Accordingly, when the liquid droplets are ejected from the nozzle, it is possible to suppress an effect of the air current on the nozzle, and to suppress the generation of mist of the liquid droplets. Accordingly, it is possible to reduce a defect caused due to the mist of liquid droplets.

In the image forming apparatus of the present invention, each of the gas discharge ports may be open to extend in the scanning direction. In this case, since the gas taken via the gas inlet port is discharged through the pair of gas discharge ports each of which extends in the scanning direction, it is possible to form the air curtain along the scanning direction, on both sides in the direction orthogonal to the scanning direction, interposing the nozzles therebetween. Accordingly, the air current which spreads over the both sides orthogonal to the scanning direction is suppressed, and it is possible to land the liquid droplets jetted from the nozzle on the recording medium without being deflected in the direction orthogonal to the scanning direction, and to make a diameter and a shape of dots uniform.

The image forming apparatus of the present invention may further include a guide member which guides the gas, taken into the head unit via the gas inlet port, to the pair of gas discharge ports. In this case, it is possible to guide the gas taken via the gas inlet port to the pair of gas discharge ports by the guide member. Accordingly, it is possible to increase a flow of the gas discharged from the pair of gas discharge ports, and to improve a wind-shield effect by the air curtain.

In the image forming apparatus of the present invention, the side wall may include a first side wall on one side in the scanning direction of the head unit, and a second side wall on the other side in the scanning direction; and the gas inlet port may have a first gas inlet port which is open in the first side wall, and via which the gas is taken into the head unit when the head unit moves in the one side of the scanning direction, and a second gas inlet port which is open in the second side wall and via which the gas is taken into the head unit when the head unit moves in the other side of the scanning direction. In this case, even when the head unit moves in one side or the other side of the scanning direction, it is possible to take the gas into the head unit from the first gas inlet port or the second gas inlet port.

In the image forming apparatus of the present invention, each of the pair of gas discharge ports may have a first gas discharge port via which the gas taken into the head unit from the first gas inlet port is discharged, and a second gas discharge port via which the gas taken into the head unit through the second gas inlet port is discharged; and the guide member may have a first guide member which guides the gas taken via the first gas inlet port to the first gas discharge port, and a second guide member which guides the gas taken via the second gas inlet port to the second gas discharge port. In this case, when the head unit moves in one side of the scanning direction, the gas is taken into the head unit via the first gas inlet port, and the gas taken in is guided to the pair of first gas discharge ports by the first guide member, and discharged. Moreover, when the head unit moves in the other side of the scanning direction, the gas is taken into the head unit via the second gas inlet port, and the gas taken in is guided to the pair of second gas discharge ports by the second guide member, and discharged. In this manner, when the head unit is moved in one side or the other side of the scanning direction, it is possible to form the air curtain by the gas discharged through the pair of gas discharge ports, on both sides, with respect to the nozzles, in the direction orthogonal to the scanning direction. Consequently, it is possible to apply the present invention to the head unit which is movable in both the one side and the other side of the scanning direction. Furthermore, since it is possible to form the air curtain only by moving the head unit by a mechanism which moves the head unit, it is not necessary to provide a mechanism which is to be used only for forming the air curtain, and the purpose is served without making a structure of the entire apparatus complicated.

According to a second aspect of the present invention, there is provided a head unit which jets liquid droplets of a liquid while moving in a scanning direction, including: a jetting head which has a plurality of nozzles for jetting the liquid droplets, and which is arranged on a bottom wall of the head unit; gas inlet ports which are formed on side walls on one side and on the other side in the scanning direction of the head unit, respectively; and a pair of gas discharge ports which are formed in the bottom wall, and which extend in the scanning direction to interpose the nozzles therebetween.

When the head unit is moved in the scanning direction, the gas is taken in via the gas inlet port, and the gas taken in is discharged through the pair of the gas discharge ports, toward the recording medium. The pair of gas discharge ports is formed in the bottom wall of the head unit, to extend on both sides in the direction orthogonal to the scanning direction, interposing the nozzles therebetween. Therefore, it is possible to form a layer of gas, in other words, an air curtain, flowing through the pair of gas discharge ports toward the recording medium, along the scanning direction, interposing the nozzles. Accordingly, when the head unit is moved, it is possible to suppress the air current which spreads over the both sides orthogonal to the scanning direction, between the jetting head and the recording medium. Further, it is possible to land the liquid droplets jetted from the nozzle on the recording medium without being deflected in a direction orthogonal to the scanning direction, and thereby facilitating to make a diameter and a shape of dots uniform.

The head unit of the present invention may further include a guide member which guides a gas taken via the gas inlet ports, to the pair of gas discharge ports. In this case, it is possible to guide the gas which is taken in through the gas inlet port, to the pair of gas discharge ports by the guide member. Accordingly, it is possible to increase a flow of the gas discharged from the pair of gas discharge ports, and to improve a wind-shield effect by the air curtain.

In the head unit of the present invention, one of the gas inlet ports formed in the side wall on one side in the scanning direction may be formed as a pair of first gas inlet ports corresponding to the pair of the gas discharge ports; and the other of the gas inlet ports formed in the side wall on the other side in the scanning direction may be formed as a pair of second gas inlet ports corresponding to the pair of the gas discharge ports. In this case, since the gas inlet ports are formed corresponding to the pair of the gas discharge ports, it is possible to guide efficiently the air taken in via each of the gas inlet ports, to the gas discharge port.

In the head unit of the present invention, a non-return valve may be provided to each of the first gas inlet ports and each of the second gas inlet ports.

In the head unit of the present invention, each of the pair of gas discharge ports may have a first gas discharge port via which discharges the gas taken from the first gas inlet port is discharged, and a second gas discharge port via which the gas taken from the second gas inlet port is discharged; and the guide member may have a first guide member which guides the gas taken from the first gas inlet port to the first gas discharge port, and a second guide member which guides the gas taken from the second gas inlet port to the second gas discharge port.

The head unit of the present invention may further include: a circuit element which drives the jetting head; and a heat releasing body which releases heat of the circuit element, and the heat releasing body may be arranged in the vicinity of the guide member. In this case, it is possible to improve further a heat releasing effect of the heat releasing body by the air which is taken in via the gas inlet port, and is guided by the guide member.

According to a third aspect of the present invention, there is provided an image forming apparatus which forms an image by jetting liquid droplets of a liquid onto a recording medium, including: the head unit as defined in the second aspect of the present invention; a head-unit moving mechanism which moves the head unit; and a transporting mechanism which transports the recording medium.

DETAILED DESCRIPTION OF THE PREFERRED EMBODIMENTS

Figure 1:
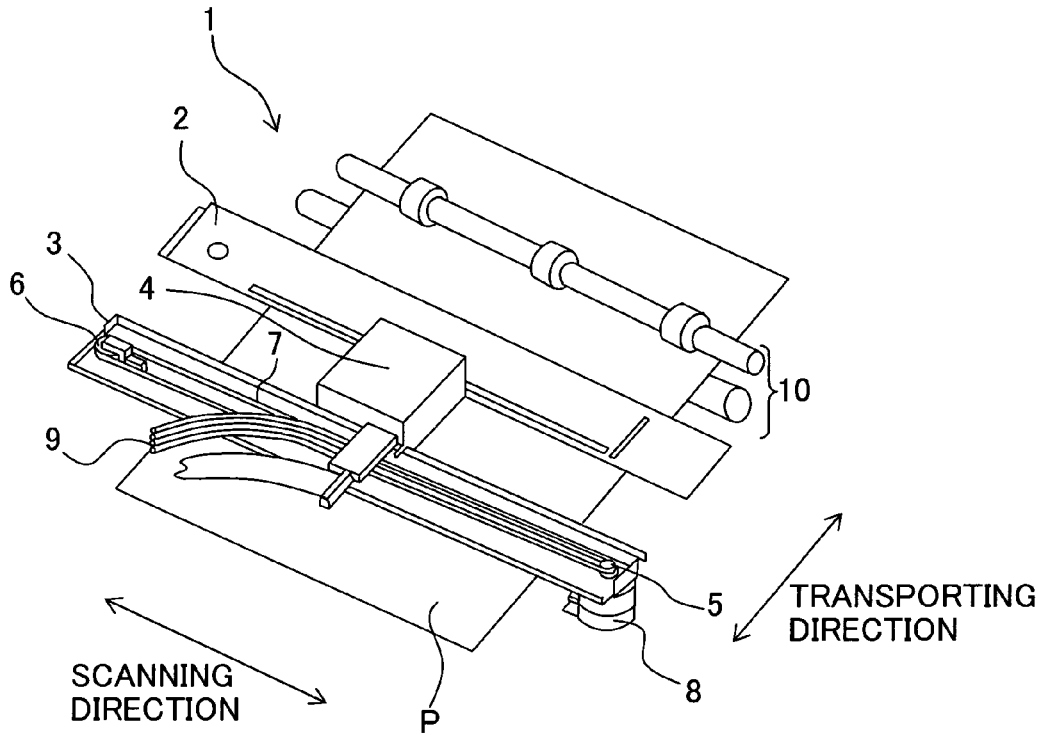
FIG. 1 is a schematic perspective view showing main components of an ink-jet printer according to a first embodiment of the present invention.

An embodiment according to the present invention will be described below by referring to the drawings. In the following description, a direction of jetting of an ink from an ink-jet head is described as a downward direction or a lower side, and a side opposite to the downward direction is described as an upward direction or an upper side.

FIG. 1 is a perspective view showing main components of an ink-jet printer 1 according the embodiment of the present invention. As shown in FIG. 1, the ink-jet printer 1 (image forming apparatus) is provided with a pair of guide rails 2 and 3 which are installed substantially in parallel, and a head unit 4 is slidably supported in a main scanning direction, by the guide rails 2 and 3. A plurality of ink supply tubes 9 which supply inks of four colors (black, cyan, magenta, and yellow) respectively from an ink tank (not shown in the diagram) is connected to the head unit 4. An ink-jet head 14 (refer to FIG. 4) having nozzles 49 exposed in a downward direction is mounted on the head unit 4. At a lower side of the ink-jet head 14, a recording paper P is transported by a transporting mechanism 10 in a direction orthogonal to the scanning direction (hereinafter, called as a 'transporting direction'), and the ink is jetted from the ink-jet head 14 toward the recording paper P which is transported. The head unit 4 is joined to a timing belt 7 which is put around a pair of pulleys 5 and 6, and the timing belt 7 is installed substantially parallel to an extending direction of the guide rail 3. A motor 8 which drives in normal and reverse rotations is provided to one pulley 5, and the timing belt 7 reciprocates by the pulley 5 being driven by the normal and the reverse rotations. With the reciprocating of the timing belt 7, the head unit 4 moves in the scanning direction along the guide rails 2 and 3. In other words, the head unit 4 is moved by a head unit moving mechanism which includes the pair of pulleys 5 and 6, the timing belt 7, the motor 8, and the guide rails 2 and 3.

Figure 2:
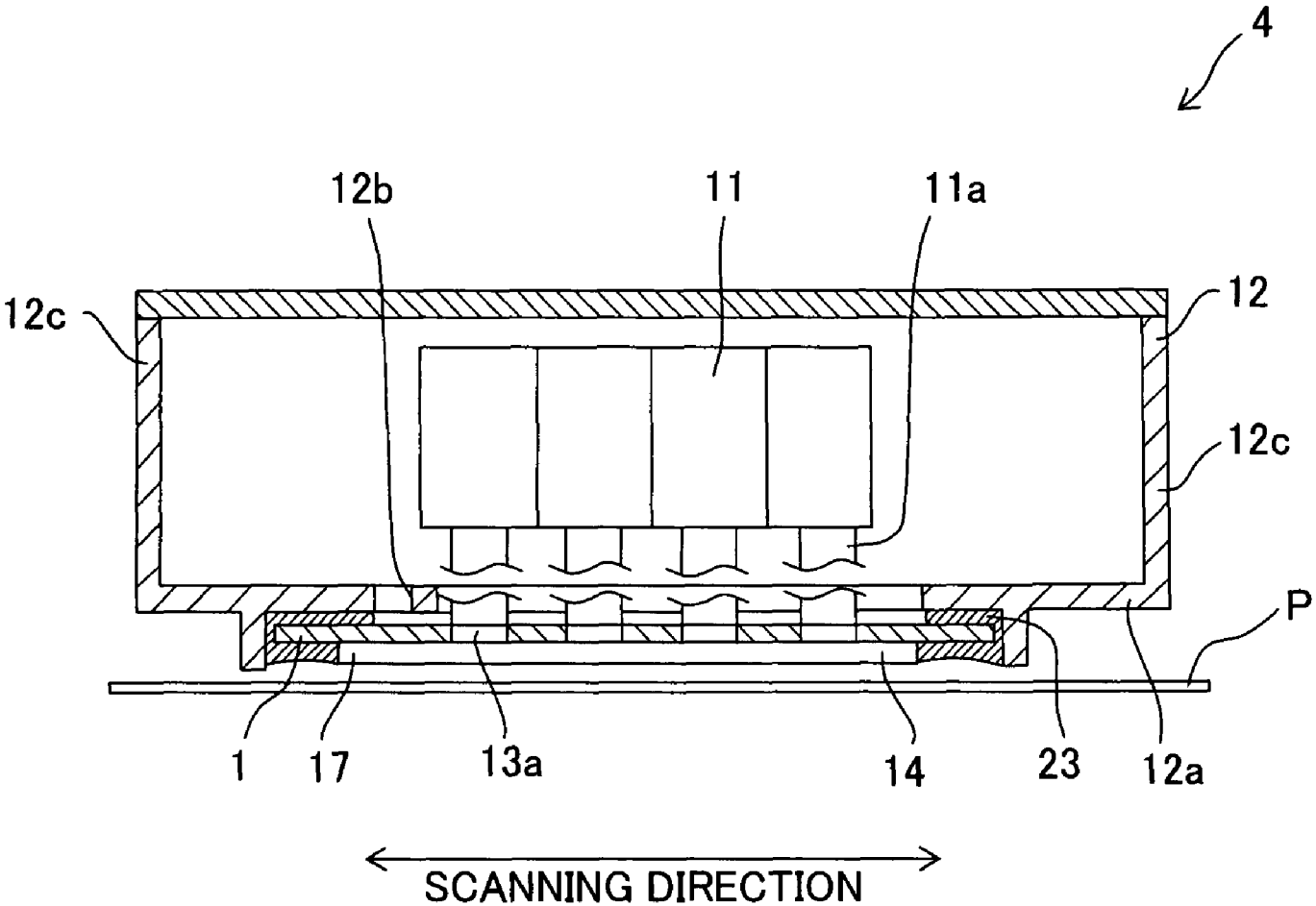
FIG. 2 is a vertical cross-sectional view of a head unit of the ink-jet printer shown in FIG. 1.

FIG. 2 is a vertical cross-sectional view of the head unit 4 of the ink-jet printer 1 shown in FIG. 1. As shown in FIG. 2, the head unit 4 accommodates a buffer tank 11 inside a box-shaped case which forms a carriage 12, and the ink-jet head 14 is installed on a lower side of a bottom wall 12*a* of the carriage 12. The buffer tank 11 has a structure such that the four inks supplied from ink tanks (not shown in the diagram) via the ink supply tubes 9 (refer to FIG. 1) are stored temporarily in four ink chambers respectively, and the ink is supplied appropriately to the ink-jet head 14 through an ink outflow port 11*a*.

Figure 4:
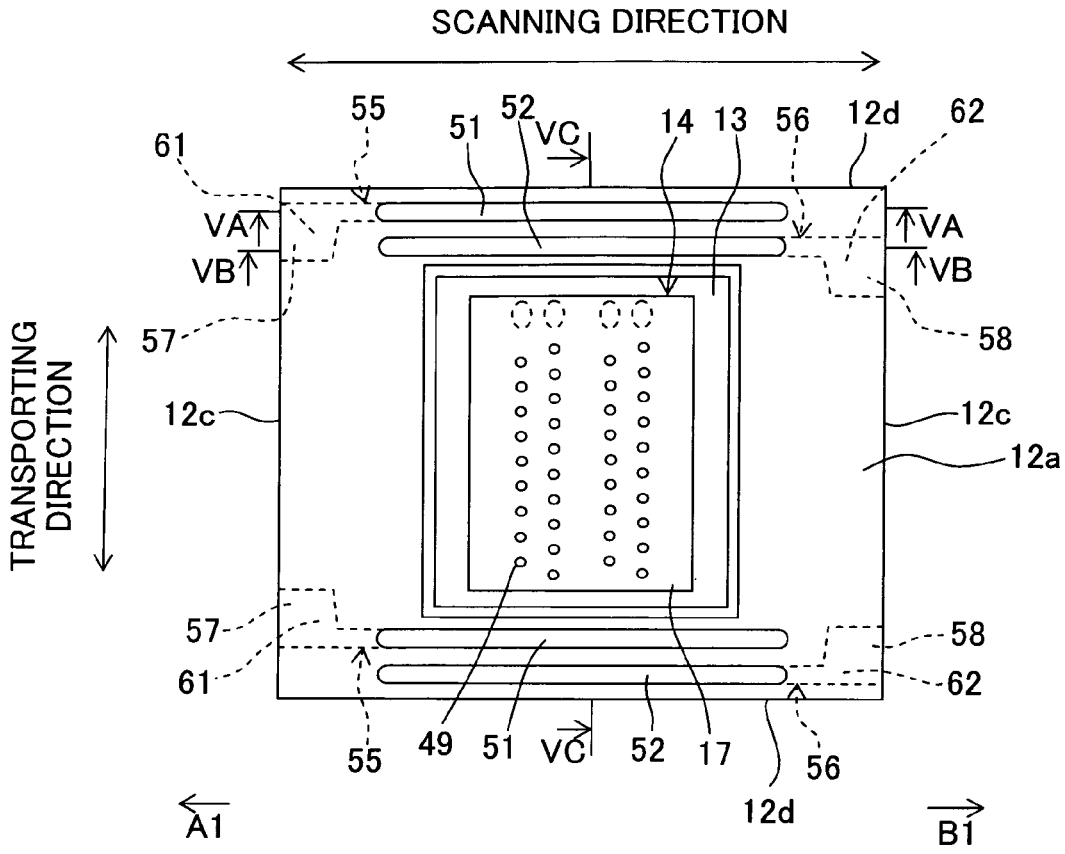
FIG. 4 is a bottom view of the head unit.

The case which forms the carriage 12 is slidably mounted on the guide rails 2 and 3 (refer to FIG. 1). The case includes the bottom wall 12*a* facing the recording paper P, front and rear walls 12*d* which erect from the bottom wall 12*a* and are parallel to a main scanning direction (refer to FIG. 4), and side walls (a first side wall and a second side wall) 12*c* which are orthogonal to the main scanning direction. As shown in FIG. 4, in a plan view, the bottom wall 12*a* is formed to be rectangular in shape, and is formed to have outer dimensions greater than outer dimensions of the ink jet head 14.

The ink-jet head 14 has the nozzles 49, in a lowermost surface, which open downward (a direction toward the recording paper P) and jet ink droplets. The nozzles 49, as shown in FIG. 4, form rows in a direction orthogonal to the main scanning direction, and a plurality of rows for various ink colors are arranged in the main scanning direction. As the ink-jet head 14, it is possible to use ink-jet heads of various jetting types such as a type in which a piezoelectric element is deformed, a type in which a vibration plate is deformed due to static electricity, or a type in which a pressure generated by boiling the ink by heating. The ink-jet head 14 is fixed to the bottom wall 12*a* of the carriage 12 via a frame plate 13 by an adhesive etc.

The head unit 4 structured in such manner moves in the scanning direction by driving the motor 8, and jets the ink from the nozzles 49 by driving an actuator 18 based on image data etc., and forms an image on the recording paper P.

A gas, concretely, an air is taken into the head unit 4 when the head unit 4 is moved in the scanning direction, and the air taken in is discharged toward the recording paper P. A structure of the head unit 4 for forming a high quality image will be described below in further detail by referring to FIG. 3 to FIG. 5.

As shown in FIG. 4, a pair of first gas discharge ports 51 and a pair of second gas discharge ports 52 are formed in the bottom wall 12*a* of the carriage 12 of the head unit 4. The pair of the first gas discharge ports 51 and the pair of the second gas discharge ports 52 extend in the scanning direction, to be arranged on both outer sides orthogonal to the scanning direction with respect to each row of the nozzles 49, in other words, interposing the ink-jet head 14 in the transporting direction of the paper. Moreover, each of the first gas discharge ports 51 and the second gas discharge ports 52 is formed to penetrate through a direction of thickness of the bottom wall 12*a*, and to have a length which is greater than a width of the plurality of rows of the nozzles 49 (width in a direction orthogonal to a direction of rows) in the main scanning direction. One of the first gas discharge ports 51 and one of the second gas discharge ports 52 are arranged in order of the first gas discharge port 51 and the second gas discharge port 52 from an outer side toward an inner side, at one side of the rows of the nozzles 49, and are arranged in order of the other side of the second gas discharge ports 52 and the other of the first gas discharge ports 51 from the outer side toward the inner side, at the other side of the rows of the nozzles 49. The first gas discharge ports 51 and the second gas discharge ports 52 may be arranged symmetrically interposing the rows of the nozzles 49.

Figure 3:
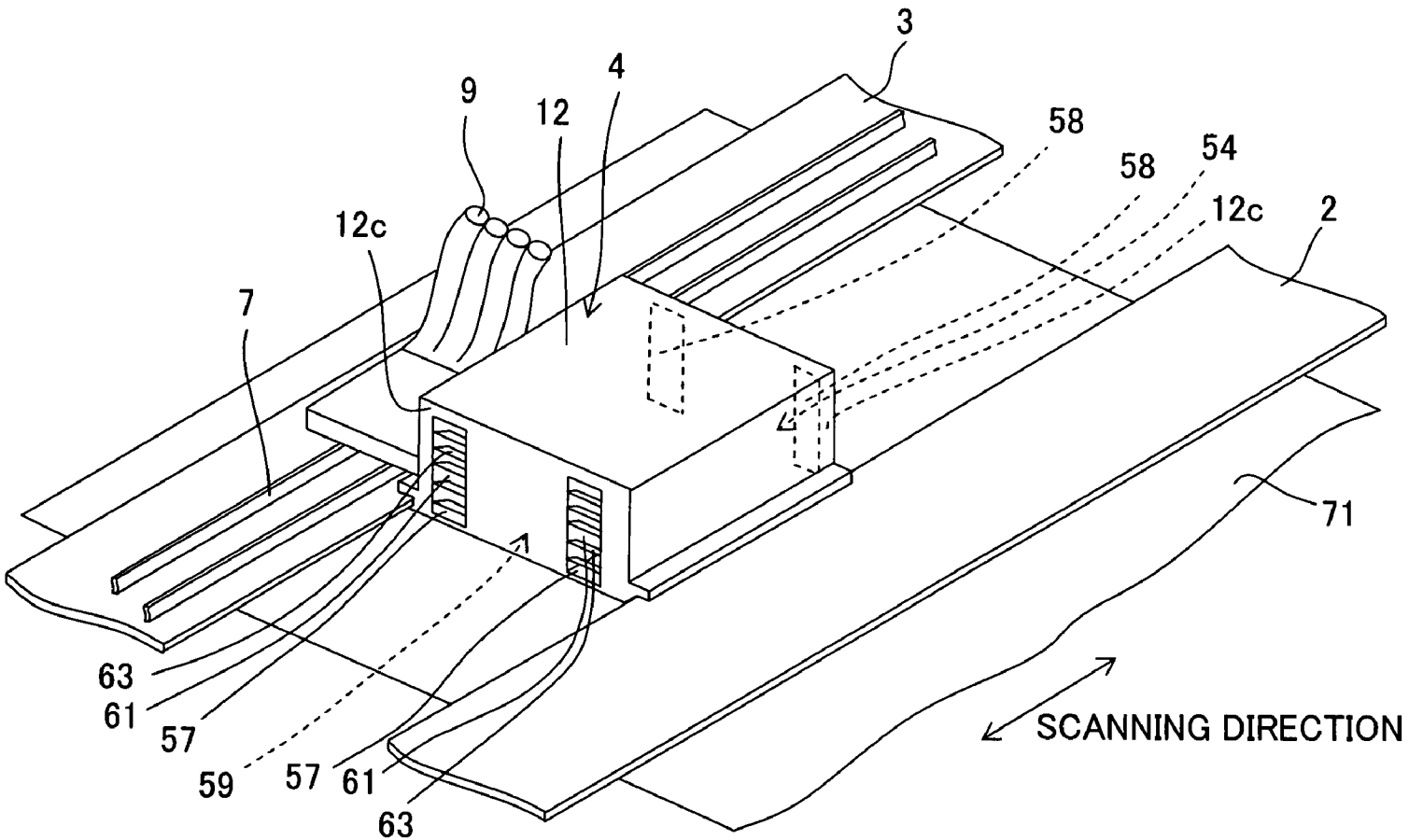
FIG. 3 is an enlarged perspective view showing the head unit which is slidably supported by a pair of guide rails.

Moreover, as shown in FIG. 3 and FIG. 4, in the both side walls 12*c* in the main scanning direction of the carriage 12, first gas inlet ports 57 which open on one side in the main scanning direction and second gas inlet ports 58 which open on the other side in the main scanning direction are formed corresponding to the first gas discharge ports 51 and the second gas discharge ports 52, respectively. The first gas inlet ports 57 and the second gas inlet ports 58, as shown in FIG. 4, communicate with the first gas discharge ports 51 and the second gas discharge ports 52 by first guide members 55 and second guide members 56. Namely, the first guide members 55 guide the gas, taken into the head unit 4 via the first gas inlet ports 57, to the first gas discharge ports 51, and the second guide members 56 guide the gas, taken into the head unit 4 via the second gas inlet ports 58, to the second gas discharge ports 52.

As shown in FIG. 4, each of the first guide members 55 has one end connected to one of the first gas inlet ports 57 of one side wall 12*c*, and passes through the carriage 12, to extend along the front and rear walls 12*d* of the carriage 12 from the first gas inlet port 57. The other end of the first guide member 55 is connected to one of the first gas discharge ports 51. At an interior of each of the first guide members 55, a first air discharge channel 61 which communicates the first gas inlet port 57 and the first gas discharge port 51 is formed. The first guide members 55 are arranged to connect the first gas discharge ports 51 and the first gas inlet ports 57 corresponding to the first gas discharge ports 51 respectively, at one side and the other side of the transporting direction.

Each of the second guide members 56 similarly, has one end connected to one of the second gas inlet ports 58 of the other side wall 12*c*, and passes through the carriage 12, to extend along the front and rear walls 12*d* of the carriage 12 from the second gas inlet port 58. The other end of the second guide member 56 is connected to one of the second gas discharge ports 52. At an interior of each of the second guide members 56, a second air discharge channel 62 which communicates the second gas inlet port 58 and the second gas discharge port 52 is formed. The second guide members 56 are also arranged to connect the second gas discharge ports 52 and the second gas inlet ports 58 corresponding to the second gas discharge ports 52 respectively, at one side and the other side of the transporting direction.

As it will be described later, for making rapid a flow of air discharged from the first gas discharge ports 51 and the second gas discharge ports 52, it is preferable to increase an area of opening of the first gas inlet ports 57 and the second gas inlet ports 58, and to increase an amount of air which is taken in. In the embodiment, both of the first guide members 55 and the second guide members 56 have an enlarged shape toward the first gas inlet ports 57 and the second gas inlet ports 58, in a plan view as shown in FIG. 4. Moreover, it is also possible to form one first gas inlet port 57 and one second gas inlet port 58 throughout an area of the both side walls 12*c* respectively, and to connect the first gas inlet port 57 to the first gas discharge ports 51 and to connect the second gas inlet port 58 to the second gas discharge ports 52, while narrowing the first air discharge channels 61 and the second air discharge channels 62.

Figure 5A:
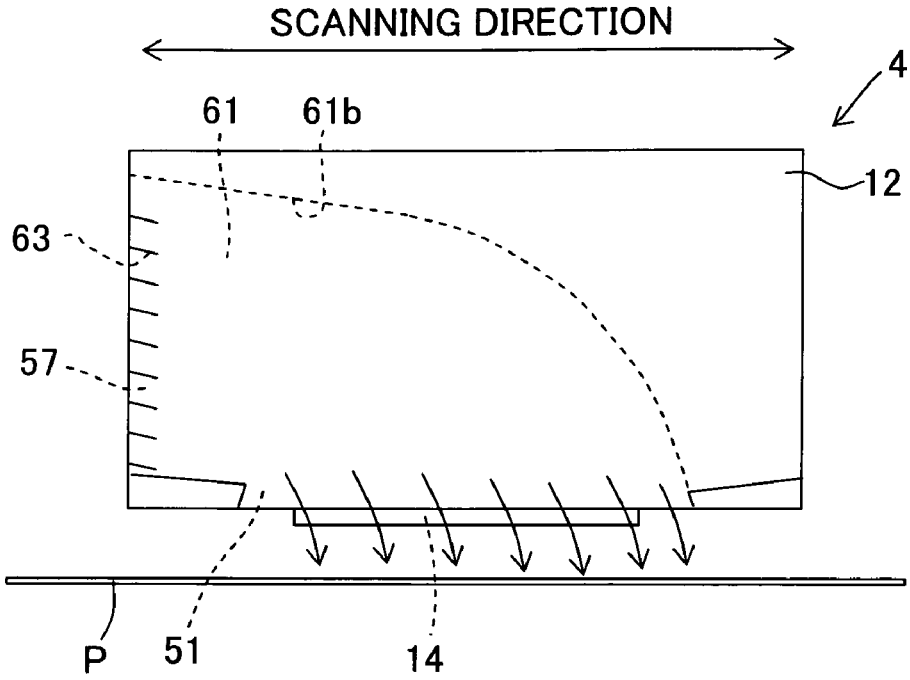
FIG. 5A is a cross-sectional view taken along a line VA-VA in FIG. 4.
Figure 5B:
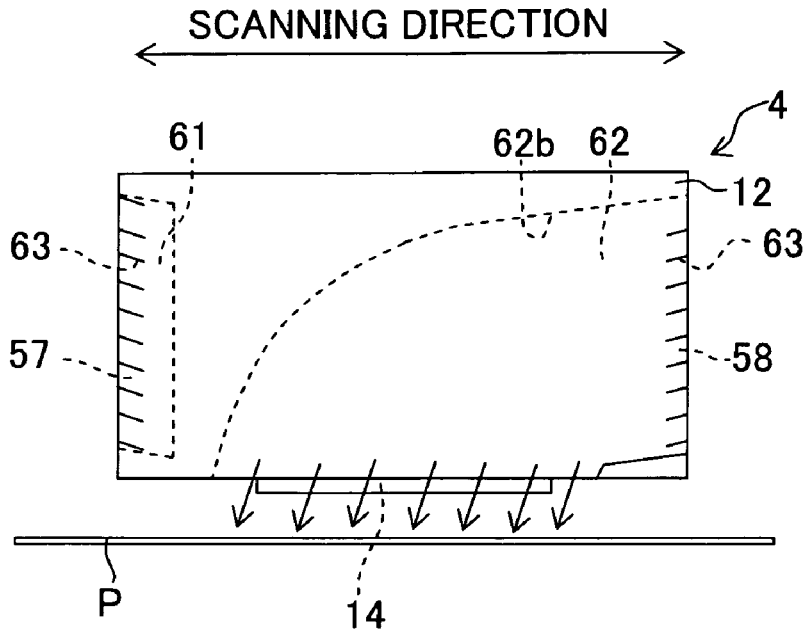
FIG. 5B is a cross-sectional view taken along a line VB-VB in FIG. 4.
Figure 5C:
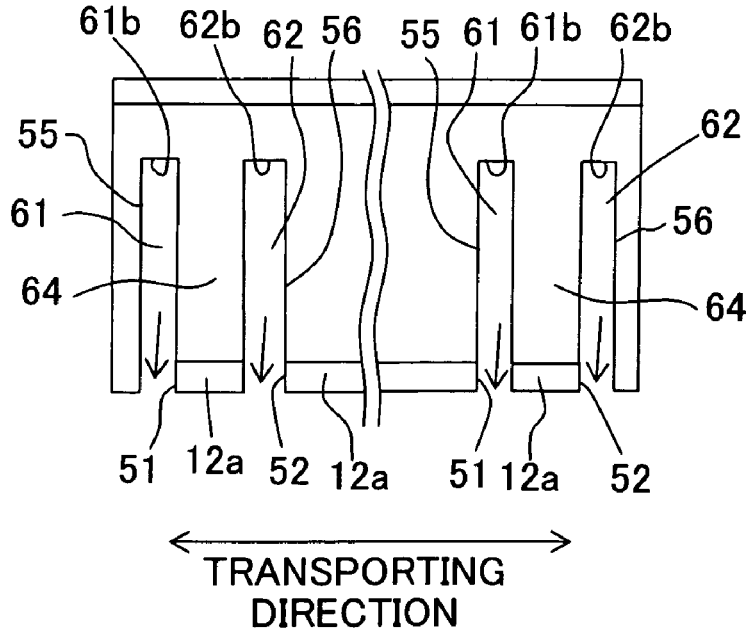
FIG. 5C is a cross-sectional view taken along a line VC-VC in FIG. 4.
Figure 6A:
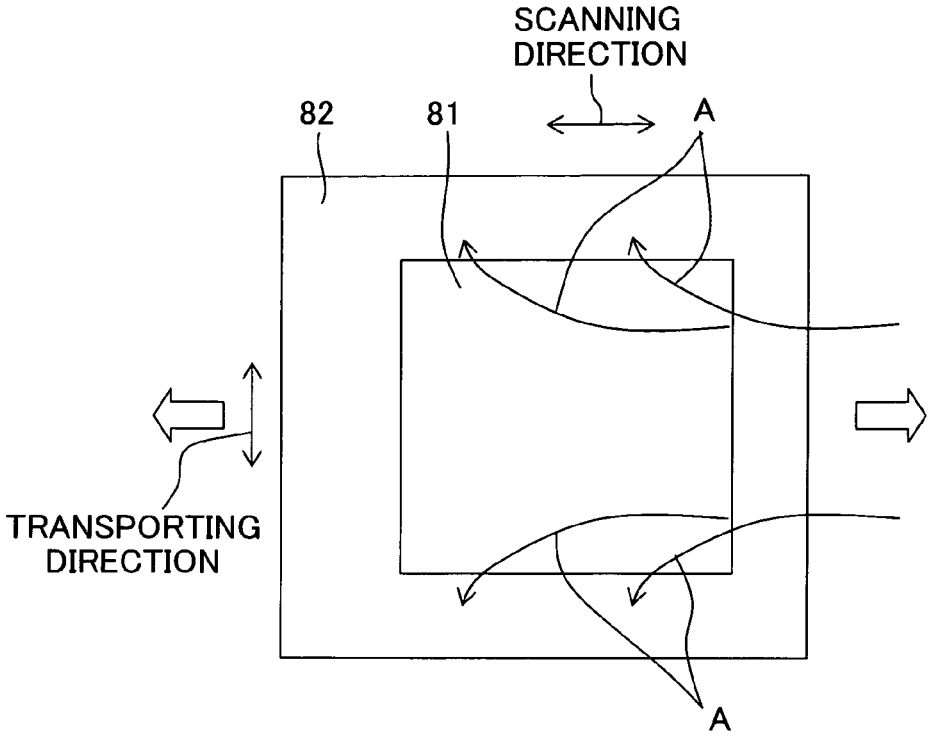
FIG. 6A is a plan view showing a flow of air between a jetting head and a recording paper in a conventional apparatus.
Figure 6B:
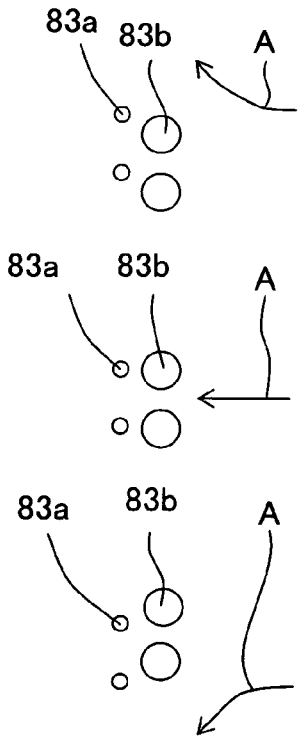
FIG. 6B is a plan view showing a landing position of a main liquid droplet and a satellite liquid droplet.

Furthermore, in the embodiment, a ceiling 61*b* of the first guide member 55 forming the first air discharge channel 61, as shown in FIG. 5A, is inclined to descend toward the bottom wall 12*a*, as advancing toward an inner side of the carriage 12 from the corresponding first gas inlet port 57, and is curved to descend toward the bottom wall 12*a* as it advances further, and communicates with an end portion on the other side (right side in FIG. 5A) in the main scanning direction of the first gas discharge port 51. A ceiling 62*b* of the second guide member 56 forming the second air discharge channel 62, as shown in FIG. 5B, is inclined to descend toward the bottom wall 12*a*, as advancing toward the inner side of the carriage 12 from the corresponding second gas inlet port 58, and is curved to descend toward the bottom wall 12*a* as it advances further, and communicates with an end portion on one side (left side in FIG. 5B) in the main scanning direction of the second gas discharge port 52. Moreover, as shown in FIG. 5C, between the first air discharge channel 61 and the second air discharge channel 62, a thin wall portion 64 which forms one side wall of the first air discharge channel 61 and one side wall of the second air discharge channel 62, extends up to the bottom wall 12*a*.

A louver 63 or a filter which blocks dust and impurities from entering is installed in each of the first gas inlet ports 57 and the second gas inlet ports 58.

When the head unit 4 is moved in one direction A1 in the main scanning direction (hereinafter, called as 'one direction A1'), an air taken in via the pair of first gas inlet ports 57 directed toward the one direction A1 is discharged downwardly toward the recording paper P from the pair of first gas discharge ports 51 via the pair of first air discharge channels

61. The air discharged from the first gas discharge ports 51 form layers of air, in other words, a pair of air curtains which extend in the scanning direction interposing the rows of the nozzles 49, on both outer sides in the direction of the rows of the nozzles 49. Moreover, when the head unit 4 is moved in the other direction B1 in the main scanning direction (hereinafter called as the 'other direction B1') opposite to the one direction A1, an air is taken via the second gas inlet ports 58. The air is discharged downwardly toward the recording paper P from the second gas discharge ports 52 via the pair of second air discharge channels 62, and forms an air curtain similarly as when the head unit 4 is moved in one direction A1. When the head unit 4 is moved in any of the one direction A1 and the other direction B1, an air flow is generated between the head unit 4 and the recording paper P. However, it is possible to suppress the generation of the air flow which spreads over both sides orthogonal to the scanning direction, by the air curtain.

Consequently, ink droplets (including the main liquid droplets and the satellite liquid droplets) are not deflected by the air flow which spreads over both sides orthogonal to the scanning direction, and it is possible to land the ink droplets at desired positions on the recording paper P. When the satellite liquid droplets in particular, are jetted from nozzles at both ends in the row of the nozzles 49 in the conventional structure, the satellite droplets land on an outer side than the main liquid droplets, due to the air flow which spreads toward both sides. In the embodiment, the main liquid droplets and the satellite liquid droplets jetted from the nozzle at any position in the row of nozzles 49 land at relatively almost the same position. Accordingly, it is possible to have a uniform shape and diameter of dots formed by ink droplets jetted from the nozzles 49.

Moreover, by forming pair of air curtains to interpose the ink-jet head 14 on both sides in the transporting direction of the ink-jet head 14, an amount of air which spreads over both sides in a direction orthogonal to the main scanning direction between the head unit 4 and the recording paper P is reduced, in other words, an amount of air entering between the ink-jet head 14 and the recording paper P is reduced. Accordingly, when the liquid droplets are projected from the nozzle 49 and divided into the main liquid droplets and the satellite liquid droplets, an effect of the air flow on the ink is reduced, and it is possible to suppress the generation of ink mist. Since the generation of the ink mist is suppressed, it is possible to reduce contamination of an interior of the image forming apparatus and occurrence of an electrical fault.

Figure 7A:
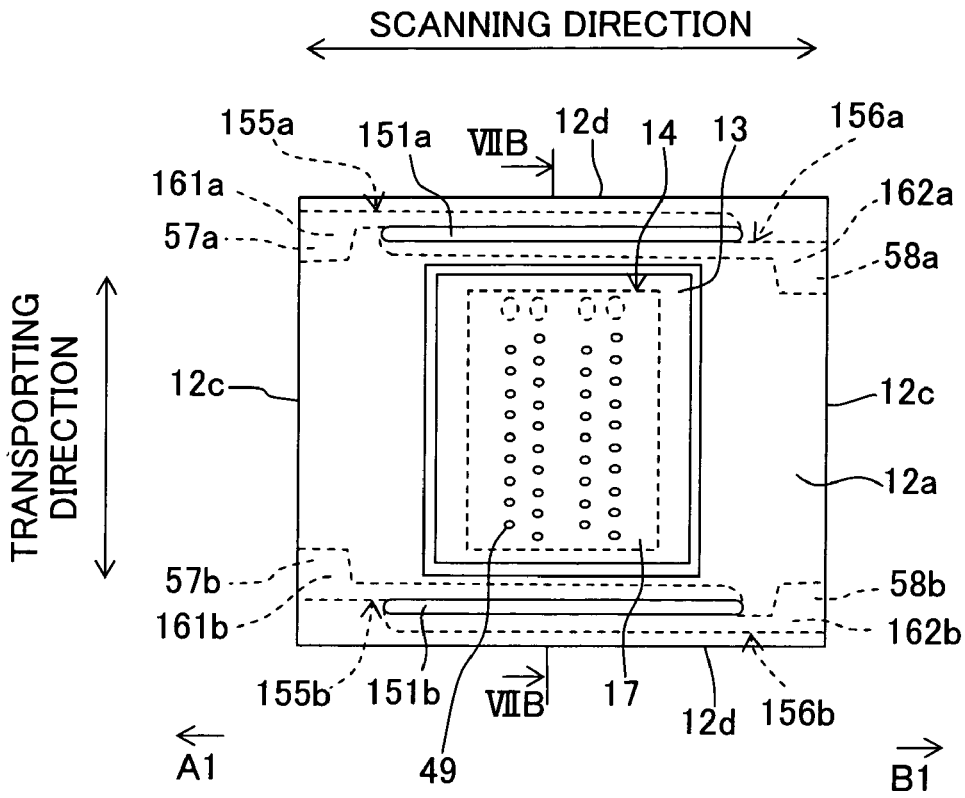
FIG. 7A is a bottom view of a head unit of a first modified embodiment.
Figure 7B:
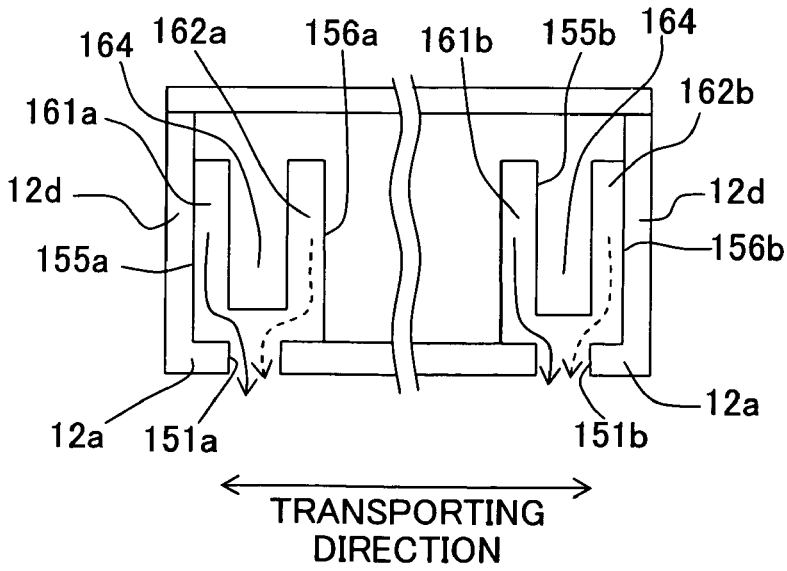
FIG. 7B is a cross-sectional view taken along a line VIIB-VIIB in FIG. 7A.

Next, a first modified embodiment will be described below by referring to FIG. 7A and FIG. 7B. FIG. 7A is a bottom view of the head unit 4 in the first modified embodiment, and FIG. 7B is a cross-sectional view taken along a line VIIB-VIIB in FIG. 7A. In the embodiment, the pair of the first gas discharge ports 51 and the pair of the second gas discharge ports 52 which extend in the scanning direction and interpose the ink-jet head 14 have been formed in the bottom wall 12*a* of the head unit 4. However, there may be only one pair of such gas discharge ports. In the first modified embodiment, as shown in FIG. 7A, a pair of gas discharge ports 151*a* and 151*b* is formed to extend in the scanning direction, interposing the ink-jet head 14, and the gas discharge port 151*a* is connected to gas inlet ports 57*a* and 58*a* on one side in the transporting direction, and the gas discharge port 151*b* is connected to gas inlet ports 57*b* and 58*b* on the other side in the transporting direction. The gas inlet ports 57*a* and 58*a* on one side in the transporting direction are connected to the gas discharge port 151*a* via guide members 155*a* and 156*a* respectively, on one side in the transporting direction, and the gas inlet ports 57*b* and 58*b* on the other side in the transporting direction are connected to the gas discharge port 151*b* via guide members 155*b* and 156*b* respectively, on the other side in the transporting direction. A three-dimensional shape of each guide member is almost same as in the embodiment, Out as shown in FIG. 7B, a thin wall portion 164 between the guide members 155*a* and 156*a* on the one side in the transporting direction does not extend up to the bottom wall 12*a*. Further, the first modified embodiment is different from the embodiment in that the guide members 155*a* and 156*a* are merged mutually in the vicinity of the gas discharge port 151*a*. Moreover, also a thin wall portion 164 between the guide members 155*b* and 156*b* on the other side in the transporting direction does not extend up to the bottom wall 12*a*, and the guide members 155*b* and 156*b* are merged mutually in the vicinity of the gas discharge port 151*b*.

Even in the first modified embodiment, when the head unit 4 is moved to one side A1 in the scanning direction, air is taken in via the gas inlet ports 57*a* and 57*b* on the side of A1, and the air which is taken from the gas inlet port 57*a* is discharged through the gas discharge port 151*a* via an air discharge channel 161*a* inside the guide member 155*a*, and the air which is taken from the gas inlet port 57*b* is discharged through the gas discharge port 151*b* via an air discharge channel 161*b* inside the guide member 155*b*. When the head unit 4 is moved to the other side B1 in the scanning direction, air is taken in from the gas inlet ports 58*a* and 58*b* on the side of B1, and the air which is taken from the gas inlet port 58*a* is discharged through the gas discharge port 151*a* via an air discharge channel 162*a* inside the guide member 156*a*, and the air which is taken from the gas inlet port 58*b* is discharged through the gas discharge port 151*b* via an air discharge channel 162*b* inside the guide member 156*b*. Since the guide member 155*a* is merged with the guide member 156*a* in the vicinity of the gas discharge port 151*a*, it is possible to reduce an amount of air flowing through one of the air discharge channels 161*a* and 162*a* from flowing into the other of the air discharge channels. Similarly, since the guide member 155*b* is merged with the guide member 156*b* in the vicinity of the gas discharge port 151*b*, it is possible to reduce an amount of air flowing through one of the air discharge channels 161*b* and 162*b* from flowing into the other of the air discharge channels. As it has been described above, even in the first modified embodiment, it is possible to achieve an effect similar as in the embodiment. Moreover, in the first modified embodiment, since only one pair of gas discharge ports is formed, even when the head unit 4 is moved in any sides of the scanning direction, it is possible to form the air curtain at the same position with respect to the ink-jet head 14. Accordingly, it is possible to achieve a constant wind-shield effect independent of the movement direction of the head unit 4.

Figure 8A:
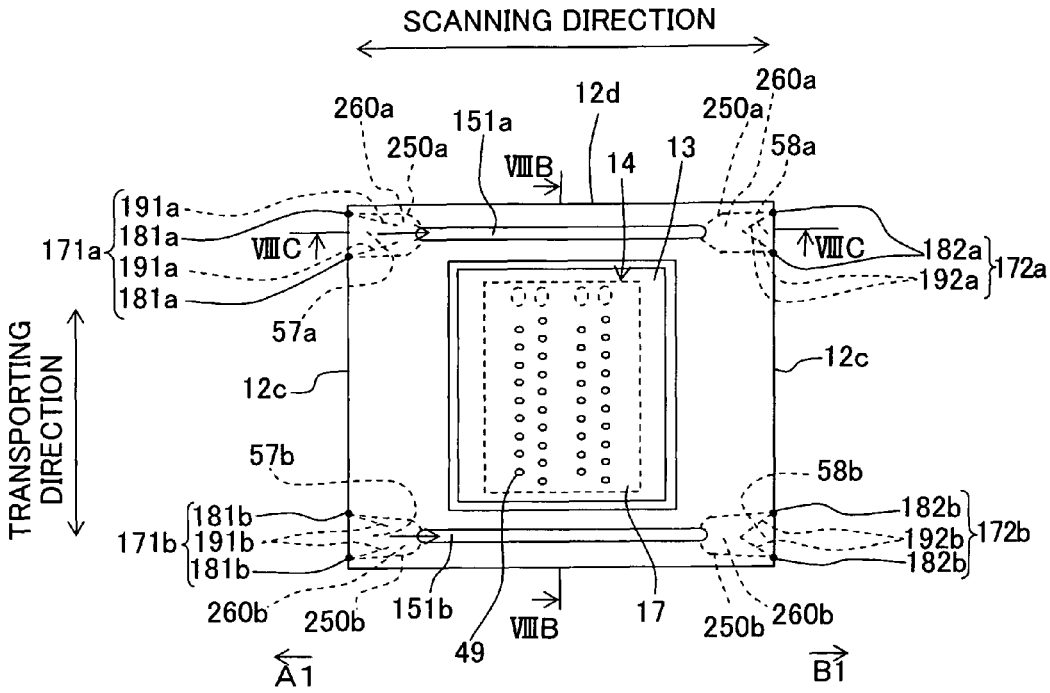
FIG. 8A is a bottom view of a head unit of a second modified embodiment.
Figure 8B:
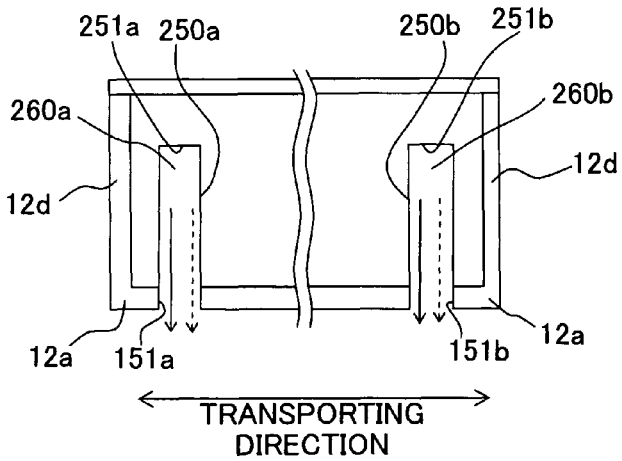
FIG. 8B is a cross-sectional view taken along a line VIIIB-VIIIB in FIG. 8A.
Figure 8C:
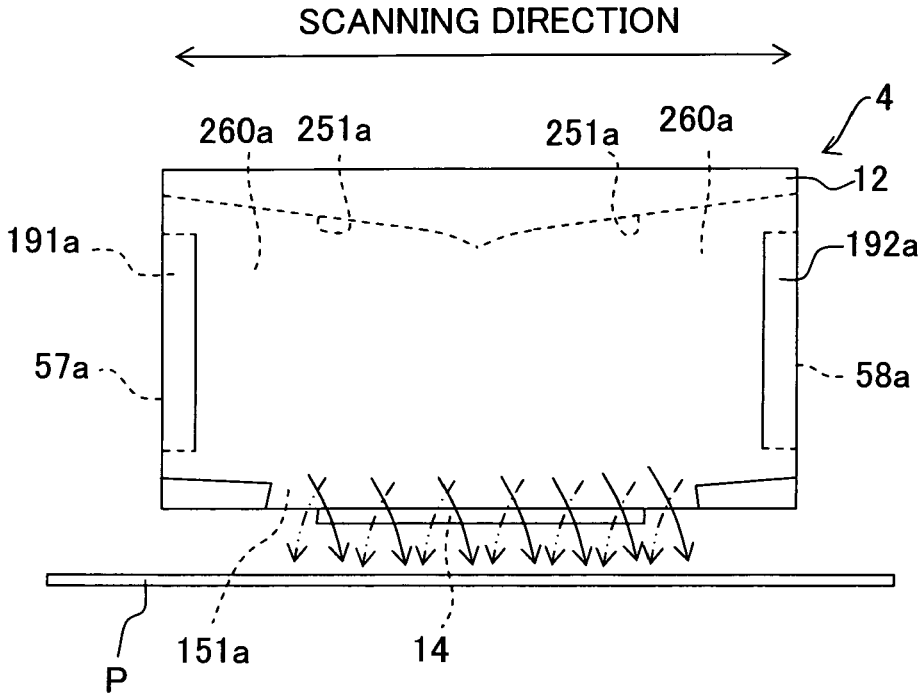
FIG. 8C is a cross-sectional view taken along a line VIIIC-VIIIC in FIG. 8A.

Next, a second modified embodiment which is an embodiment upon making further modifications in the first modified embodiment will be described below by referring to FIG. 8A to FIG. 8C. FIG. 8A is a bottom view of the head unit 4 in the second modified embodiment. FIG. 8B is a cross-sectional view taken along a line VIIIB-VIIIB in FIG. 8A. FIG. 8C is a cross-sectional view taken along a line VIIIC-VIIIC in FIG. 8A. Even in the second modified embodiment, similarly as in the first modified embodiment, the pair of gas discharge ports 151*a* and 151*b* is formed to extend in the scanning direction, interposing the ink-jet head 14, and the gas discharge port 151*a* is connected to the gas inlet ports 57*a* and 58*a* on one side in the transporting direction, and the gas discharge port 151*b* is connected to the gas discharge ports 57*b* and 58*b* on the other side in the transporting direction. The second modified embodiment is different from the first modified embodiment in that non-return valves 171*a*, 171*b*, 172*a*, and 172*b* are attached to the gas inlet ports 57*a* and 57*b* on one side A1 in the scanning direction, and to the gas inlet ports 58*a* and 58*b* on the other side B1 in the scanning direction, respectively so that the non-return valves 171*a*, 171*b*, 172*a*, and 172*b* direct toward the inside of the head unit 4. Moreover, the second modified embodiment is different from the first modified embodiment in that a guide member 250*a* which connects the gas inlet port 57*a* and the gas discharge port 151*a* also serves as a guide member which connects the gas inlet port 58*a* and the gas discharge port 151*a*, and a guide member 250*b* which connects the gas inlet port 57*b* and the gas discharge port 151*b* also serves as a guide member which connects the gas inlet port 58*b* and the gas discharge port 151*b*. Moreover, as shown in FIG. 8C, a ceiling 251*a* of the guide member 250*a* is inclined to be descended from the corresponding gas inlet ports 57*a* and 58*b* toward the bottom wall 12*a*, as advancing toward an inner side of the carriage 12, and unlike in the first modified embodiment, does not communicate with end portions on a side in the scanning direction of the gas discharge port 151*a*. A three-dimensional structure of the guide member 250*b* is similar to a three-dimensional structure of the guide member 250*a*. The non-return valve 171 has a pair of rotating shafts 181*a*, 181*a* which is provided to the side wall 12*c* at the interior of the head unit 4 and each of which extends along an edge on both sides in the transporting direction of the gas inlet port 57*a*, and a pair of opening and closing members 191*a*, 191*a* attached to the rotating shafts 181*a* respectively, and bias members which are attached to the rotating shafts 181*a* respectively and apply biases to the opening and closing members 191*a* in a predetermined direction respectively. The pair of opening and closing members 191*a*, 191*a* is installed to be directed toward the interior of the head unit 4, and a bias is applied thereon in a direction of closing the gas inlet port 57*a* by the bias members. As a bias member, for example, a coil spring coiled around the rotating shaft 181*a* or a plate spring attached to the rotating shaft 181*a* are usable. Therefore, edges, of the pair of opening and closing members 191*a*, on a side opposite to the two rotating shafts 181*a*, overlap mutually at the interior of the head unit 4, and it is possible to prevent the air inside the head unit 4 from flowing out through the gas inlet port 57*a*. On the other hand, when the head unit 4 is moved and air enters into the head unit 4 through the gas inlet port 57*a*, the pair of opening and closing members 191*a* and 191*a* is pushed open by the air, and the air is taken into the head unit 4. A structure of the other non-return valves 171*b*, 172*a*, and 172*b* is similar to the structure of the non-return valve 171*a*.

When the head unit 4 moves to one side A1 in the scanning direction, the non-return valves 171*a* and 171*b* attached to the gas inlet ports 57*a* and 57*b* respectively on the side A1 are opened, and air is taken in. The air taken in from the gas inlet port 57*a*, moves through an air discharge channel 260*a* inside the guide member 250*a*. Since the non-return valve 172*a* of the gas inlet port 58*a* is closed, the air does not escape through the gas inlet port 58*a*, and is discharged through the gas discharge port 151*a*. Similarly, the air taken in from the gas inlet port 57*b*, moves through an air discharge channel 260*b* inside the guide member 250*b*. Since the non-return valve 172*b* of the gas inlet port 58*b* is closed, the air does not escape through the gas inlet port 58*b*, and is discharged through the gas discharge port 151*b*. When the head unit 4 is moved to the other side B1 in the scanning direction, the non-return valves 172*a* and 172*b* attached to the gas inlet ports 58*a* and 58*b* on the side B1 are opened, and air is taken in. The air taken in from the gas inlet port 58*a* moves through the air discharge channel 260*a* inside the guide member 250*a*. Since the non-return valve 171*a* of the gas inlet port 57*a* is closed, the air does not escape through the gas inlet port 57*a*, and is discharged through the gas discharge port 151*a*. Similarly, the air taken in from the gas inlet port 58*b*, moves through the air discharge channel 260*b* inside the guide member 250*b*. Since the non-return valve 171*b* of the gas inlet port 57*b* is closed, the air does not escape through the gas inlet port 57*b*, and is discharged through the gas discharge port 151*b*. By an operation described above, in the second modified embodiment, it is possible to have an effect similar as in the first modified embodiment. Moreover, the guide member 250*a* which connects the gas inlet port 57*a* and the gas discharge port 151*a* also serves as a guide member which connects the gas inlet port 58*a* and the gas discharge port 151*a*, and the guide member 250*b* which connects the gas inlet port 57*b* and the gas discharge port 151*b* also serves as a guide member which connects the gas inlet port 58*b* and the gas discharge port 151*b*. Accordingly, it is possible to simplify a structure of the air discharge channels as compared to the structure in the first modified embodiment.

Figure 9:
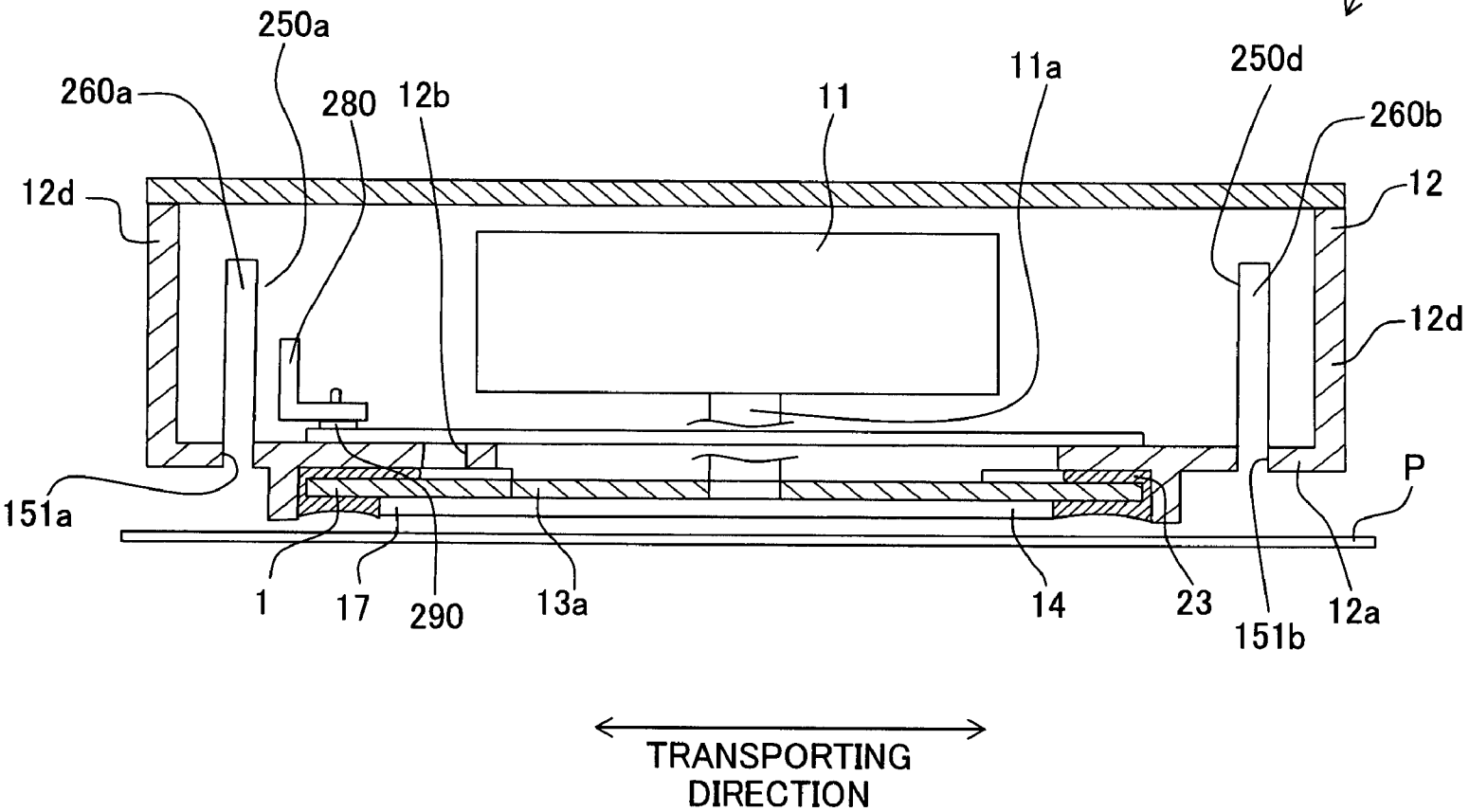
FIG. 9 is a vertical cross-sectional view of the head unit of the second modified embodiment.

In the embodiment and the modified embodiments described above, since a temperature of a driving circuit 290 provided for driving the actuator 18 rises when the actuator 18 is driven, a heat releasing body 280 for releasing heat from the driving circuit 290 may be provided. In this case, as shown in FIG. 9 for example, when the heat releasing body 280 is arranged in the vicinity of the guide member 250*a*, due to flowing of the air taken in from the gas inlet port through the air discharge channel 260*a* in the guide member 250*a*, it is possible to improve a heat releasing effect of the heat releasing body 250*a*.

In the embodiment and the modified embodiments described above, the air which is discharged from the air discharge ports may be inclined not only in a direction orthogonal to the recording paper but also in one direction with respect to the scanning direction or the direction orthogonal to the scanning direction.

Moreover, in the embodiment and the modified embodiments described above, although air is taken in and discharged when the head unit is moved, the structure is not necessarily restricted to such a structure. For example, the pair of gas discharge ports may be replaced by an air discharge fan, and the pair of gas inlet ports may be replaced by an air intake fan, and the air may be taken in and discharged forcibly.

Moreover, the embodiment and the modified embodiments described above are embodiments in which, the present invention is applied to an apparatus using, an ink as a liquid. However, the application of the present invention is not restricted to the embodiments and the modified embodiments described above. The present invention is also applicable to an apparatus which jets droplets of a liquid, used in various fields such as medical treatment and analysis, provided that the apparatus is required to land liquid droplets jetted from a nozzle on an object without the liquid droplets being deflected in a direction orthogonal to the scanning direction, by preventing an air current from spreading over both sides in a direction orthogonal to the movement direction of the head, between the jetting head and the object, when the head unit is moved. Moreover, the present invention may be applied to an image forming apparatus in which a liquid other than ink is used, such as an apparatus which applies a colored liquid at the time of manufacturing a color filter of a liquid-crystal display apparatus.

What is claimed is:

1. An image forming apparatus which forms an image by jetting liquid droplets of a liquid onto a recording medium, the apparatus comprising:

a head unit which has, on a bottom wall of the head unit, a jetting head having a plurality of nozzles for jetting the liquid droplets, and which jets the liquid droplets from the nozzles onto the recording medium while moving in a scanning direction;

a gas inlet port which is open through a side wall, the side wall being orthogonal to the scanning direction of the head unit, and via which a gas is taken into the head unit when the head unit moves in the scanning direction; and a pair of gas discharge ports which is open through the bottom wall of the head unit, at positions on both sides in a direction orthogonal to the scanning direction, to interpose the nozzles therebetween, and via which the gas, taken from the gas inlet port, is discharged toward the recording medium.

2. The image forming apparatus according to claim 1, wherein each of the gas discharge ports is open to extend in the scanning direction.

3. The image forming apparatus according to claim 2, further comprising a guide member which guides the gas, taken into the head unit via the gas inlet port, to the pair of gas discharge ports.

4. The image forming apparatus according to claim 3, wherein the side wall includes a first side wall on one side in the scanning direction of the head unit, and a second side wall on the other side in the scanning direction; and the gas inlet port has a first gas inlet port which is open in the first side wall, and via which the gas is taken into the head unit when the head unit moves in the one side of the scanning direction, and a second gas inlet port which is open in the second side wall and via which the gas is taken into the head unit when the head unit moves in the other side of the scanning direction.

5. The image forming apparatus according to claim 4, wherein each of the pair of gas discharge ports has a first gas discharge port via which the gas taken into the head unit from the first gas inlet port is discharged, and a second gas discharge port via which the gas taken into the head unit through the second gas inlet port is discharged; and the guide member has a first guide member which guides the gas taken via the first gas inlet port to the first gas discharge port, and a second guide member which guides the gas taken via the second gas inlet port to the second gas discharge port.

6. A head unit which jets liquid droplets of a liquid while moving in a scanning direction, comprising:

a jetting head which has a plurality of nozzles for jetting the liquid droplets, and which is arranged on a bottom wall of the head unit;

gas inlet ports which are formed on side walls on one side and on the other side in the scanning direction of the head unit, respectively; and a pair of gas discharge ports which are formed in the bottom wall, and which extend in the scanning direction to interpose the nozzles therebetween.

7. The head unit according to claim 6, further comprising a guide member which guides a gas taken via the gas inlet ports, to the pair of gas discharge ports.

8. The head unit according to claim 7, wherein each of the pair of gas discharge ports has a first gas discharge port via which discharges the gas taken from the first gas inlet port is discharged, and a second gas discharge port via which the gas taken from the second gas inlet port is discharged; and the guide member has a first guide member which guides the gas taken from the first gas inlet port to the first gas discharge port, and a second guide member which guides the gas taken from the second gas inlet port to the second gas discharge port.

9. The head unit according to claim 7, further comprising:

a circuit element which drives the jetting head; and a heat releasing body which releases heat of the circuit element, wherein the heat releasing body is arranged in the vicinity of the guide member.

10. The head unit according to claim 6, wherein one of the gas inlet ports formed in the side wall on one side in the scanning direction is formed as a pair of first gas inlet ports corresponding to the pair of the gas discharge ports; and the other of the gas inlet ports formed in the side wall on the other side in the scanning direction is formed as a pair of second gas inlet ports corresponding to the pair of the gas discharge ports.

11. The head unit according to claim 10, wherein a non-return valve is provided to each of the first gas inlet ports and each of the second gas inlet ports.

12. An image forming apparatus which forms an image by jetting liquid droplets of a liquid onto a recording medium, comprising:

the head unit as defined in claim 6;

a head-unit moving mechanism which moves the head unit; and a transporting mechanism which transports the recording medium.

* * * * *